US007276995B2

(12) United States Patent
Hamada et al.

(10) Patent No.: US 7,276,995 B2
(45) Date of Patent: Oct. 2, 2007

(54) FILTER

(75) Inventors: Tomoko Hamada, Kawasaki (JP); Hiroshi Nakano, Yamanashi (JP)

(73) Assignee: Eudyna Devices, Inc., Yamanashi (JP)

( * ) Notice: Subject to any disclaimer, the term of this patent is extended or adjusted under 35 U.S.C. 154(b) by 0 days.

(21) Appl. No.: 10/959,432

(22) Filed: Oct. 7, 2004

(65) Prior Publication Data

US 2005/0253671 A1 Nov. 17, 2005

(30) Foreign Application Priority Data

Oct. 8, 2003 (JP) ..... 2003-350151

(51) Int. Cl.
*H01P 1/203* (2006.01)

(52) U.S. Cl. ..... 333/204; 333/219

(58) Field of Classification Search ..... 333/203, 333/204, 219, 219.1
See application file for complete search history.

(56) References Cited

U.S. PATENT DOCUMENTS

| | | | | |
|---|---|---|---|---|
| 3,451,015 | A * | 6/1969 | Heath | 333/203 |
| 4,701,727 | A * | 10/1987 | Wong | 333/204 |
| 5,136,269 | A * | 8/1992 | Seitzer et al. | 333/204 |
| 5,142,255 | A * | 8/1992 | Chang et al. | 333/204 |
| 5,442,330 | A * | 8/1995 | Fuller et al. | 333/204 |
| 6,166,612 | A * | 12/2000 | Tsujiguchi | 333/204 |
| 6,184,760 | B1 * | 2/2001 | Wada et al. | 333/204 |
| 2004/0095212 | A1 * | 5/2004 | Iwasaki et al. | 333/204 |
| 2004/0104792 | A1 * | 6/2004 | Kim et al. | 333/204 |

FOREIGN PATENT DOCUMENTS

| | | |
|---|---|---|
| JP | 4-249901 A | 9/1992 |
| JP | 11-220304 A | 8/1999 |
| JP | 11-355009 A | 12/1999 |
| JP | 2002-26605 | 1/2002 |

OTHER PUBLICATIONS

Hong et al., "Canonical Microstrip Filter using Square Open-loop Resonators," Electronic Letters, vol. 31, No. 23, Nov. 9, 1995, pp. 2020-2022.*

Yoshihisa Amano et al., "Low Cost Planar Filter for 60 GHz Applications", 30th European Microwave Conference in Paris 2000, pp. 340-343.

* cited by examiner

*Primary Examiner*—Seungsook Ham
(74) *Attorney, Agent, or Firm*—Westerman, Hattori, Daniels & Adrian, LLP.

(57) ABSTRACT

A filter includes first and second line patterns each having a length substantially equal to ½ of the wavelength of a pass-band frequency, and a resonator that is interposed between the first and second line patterns and is coupled therewith so that the first and second line patterns have open stubs in which connection points between input/output terminals and the first and second line patterns appear to be short-circuited when viewed from ends of the first and second line patterns.

6 Claims, 7 Drawing Sheets

λ/4 SINGLE-END RESONATOR

λ/2 OPEN-LINE RESONATOR

CAPACITOR-LOADED λ/2
OPEN-LINE RESONATOR

BENT λ/2 OPEN-LINE RESONATOR

RING-TYPE RESONATOR

λ/4 SINGLE-END RESONATOR

λ/2 LINE RESONATOR WITH BOTH ENDS SHORT-CIRCUITED

λ/2 OPEN-LINE RESONATOR WITH BOTH ENDS OPEN (c)

DIELECTRIC RESONATOR

FILTER

BACKGROUND OF THE INVENTION

1. Field of the Invention

The present invention generally relates to a filter, and more particularly, to a filter that is used in high-frequency ranges having wavelengths of, for example, microwaves, sub-millimeters or millimeters.

2. Description of the Related Art

In general, filters used in high-frequency ranges are formed with distributed constant circuits, which may, for example, include microstrip lines or coplanar lines. Filters using microstrip lines are disclosed in Japanese Patent Application Publication No. 2002-026605 and "Low Cost Planar Filter for 60 GHz Applications (Yoshihisa Amano, et al., $30^{th}$ European Microwave Conference in Paris 2000, pp. 340-343)". In each of those filters, two λ/2 open-line resonators (λ being the wavelength of an electric signal propagating through the line in the vicinity of the center frequency of the pass band) are connected through capacitive coupling by an electromagnetic coupler, and an input terminal and an output terminal are connected through mutually inductive coupling by an electromagnetic coupler. With this structure, the frequencies of the attenuation poles can approach the center frequency, and the cut-off profile of the filter frequency can become sharper.

With the prior art disclosed in Japanese Patent Application Publication No. 2002-026605, however, the patterns are too complicated to reduce the size of the filter, and only a low degree of freedom is allowed in the stage of designing the filter.

SUMMARY OF THE INVENTION

It is therefore an object of the present invention to provide a filter in which the above disadvantage is eliminated.

A more specific object of the present invention is to provide a filter with a simpler structure and a higher degree of freedom in design.

The above objects of the present invention are achieved by a filter includes first and second line patterns each having a length substantially equal to ½ of the wavelength of a pass-band frequency, and a resonator that is interposed between the first and second line patterns and is coupled therewith so that the first and second line patterns have open stubs in which connection points between input/output terminals and the first and second line patterns appear to be short-circuited when viewed from ends of the first and second line patterns.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

Figure 1:
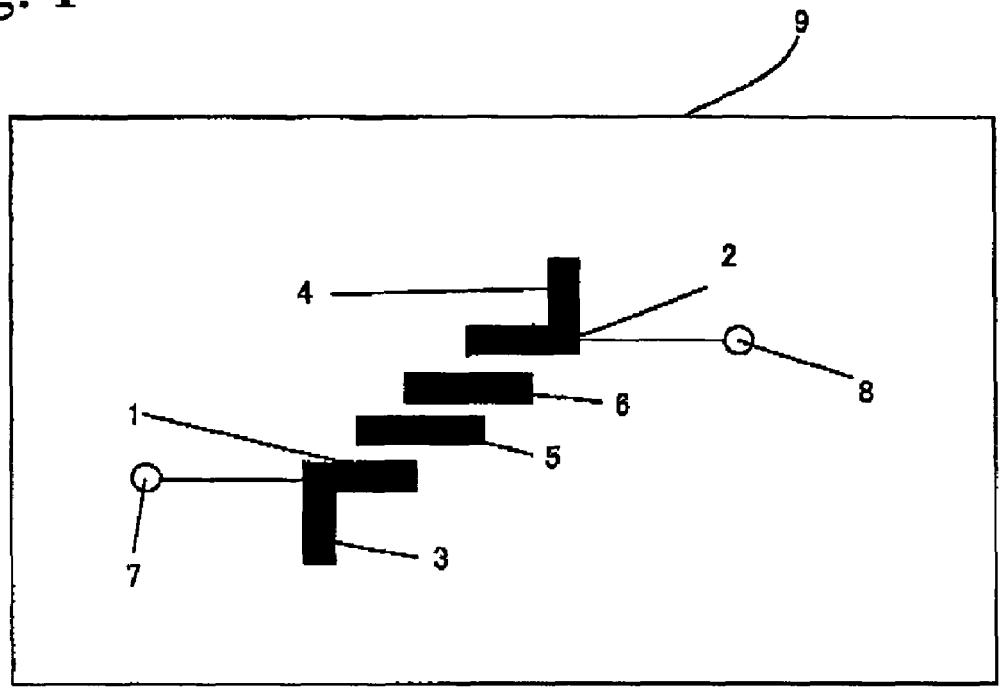
FIG. 1 illustrates a filter as a comparative example of the present invention.

So as to solve the above-described problem, the inventors used stubs in a filter. FIG. 1 illustrates the structure of a filter that employs stubs. The filter shown in FIG. 1 was developed by the inventors in the course of inventing the present invention, and functions as a bandpass filter. In the following, the filter shown in FIG. 1 will be referred to as a comparative example.

The filter shown in FIG. 1 includes microstrip lines 1 and 2, resonators 5 and 6, and input/output terminals 7 and 8. These patterns are formed on a dielectric substrate 9. Stub portions 3 and 4 are formed on the microstrip lines 1 and 2, respectively. Each of the microstrip lines 1 and 2 has a length of λ/2 (λ being the wavelength of an electric signal propagating through the transmission path at the center frequency of the pass band or a frequency close thereto; hereinafter the wavelength λ will be also referred to as the ½ wavelength of the pass-band frequency), and is able to efficiently input and output power. The input/output terminals 7 and 8, the microstrip lines 1 and 2, and the resonators 5 and 6 are electromagnetically coupled so as to set the pass band in the vicinity of the resonance frequency.

The stub portions 3 and 4 function as open stubs, and are designed so that the connection points between the input/output terminals 7 and 8 and the stub portions 3 and 4 appear to be short-circuited when viewed from the ends of the stub portions 3 and 4. The length of each of the stub portions 3 and 4 is λ/4, for example. As the stub portions 3 and 4 function as open stubs, attenuation poles are formed in the vicinity of the resonance frequency. It is essential to form attenuation poles in the vicinity of the resonance frequency in achieving excellent filter characteristics with a sharp cut-off profile.

However, the inventor founds out that the filter shown in FIG. 1 has a difficulty in achieving filter characteristics with a sharp cut-off profile. As described above, to achieve desirable filter characteristics, it is necessary to form attenuation poles near the pass band. Taking other conditions into consideration, however, the attenuation poles might overlap the pass band or appear far away from the pass band. The attenuation poles might not even appear at all. An electromagnetic simulator, which is used to design the filter, is to obtain approximate values with respect to the electromagnetic distribution, and therefore, cannot exhibit desired characteristics when the filter is put into practical use, though ideal characteristics can be obtained in the stage of designing. In this filter, the probability of obtaining desired attenuation poles can be increased by increasing the number of elements that form attenuation poles, i.e., increasing the number of stubs, or selecting stubs with desired characteristics. Accordingly, more freedom can be allowed in the stage of designing. However, an increased number of stubs requires more area for the added stubs, resulting in an increase in size.

Based on the above observations, the inventors have developed a filter with a simpler structure and more freedom of design.

Figure 2:
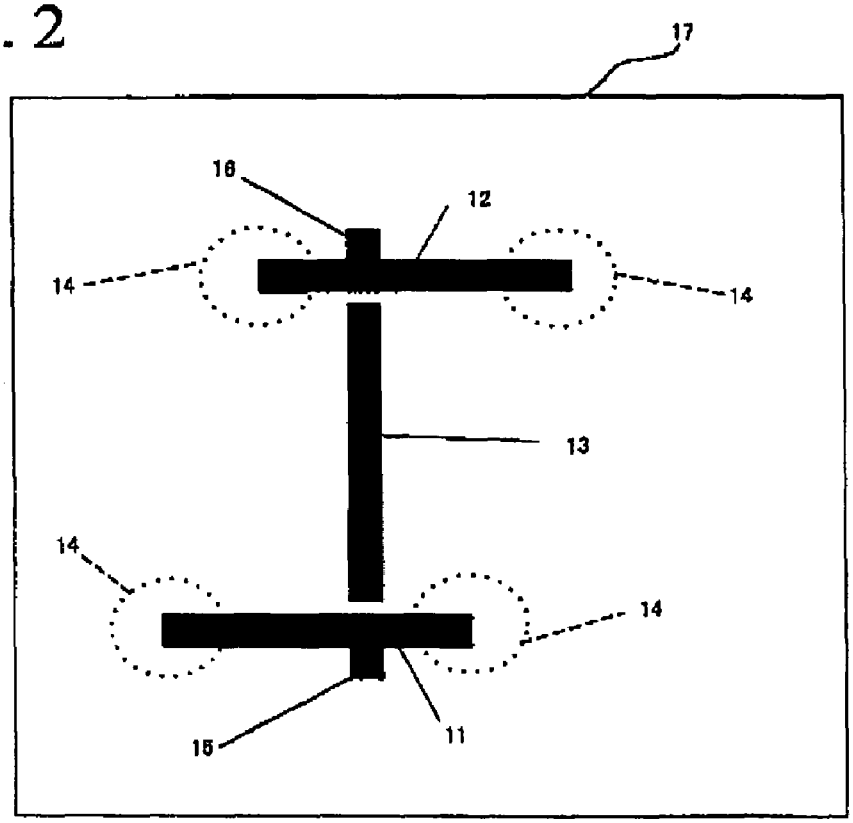
FIG. 2 illustrates the principles of the present invention.

FIG. 2 illustrates a filter that employs microstrip lines as line patterns in accordance with the present invention. The filter shown in FIG. 2 includes a dielectric substrate 17, and has a first microstrip line 11, a second microstrip line 12, a resonator 13, and input/output terminals 15 and 16, all of which are formed on the dielectric substrate 17. Each of the first microstrip line 11 and the second microstrip line 12 has a length substantially equal to ½ of the wavelength λ corresponding to the center frequency of the pass band or close thereto. The resonator 13 is interposed between the first microstrip line 11 and the second microstrip line 12. The resonator 13 and the first microstrip line 11 are coupled so that the first strip line 11 includes open stubs in which the connection point between the input/output terminal 15 and the first microstrip line 11 appears to be short-circuited when seen from ends 14 of the first microstrip line 11. The resonator 13 and the second microstrip line 12 are coupled so that the second microstrip line 12 has open stubs in which the connection point between the input/output terminal 16 and the second microstrip line 12 appears to be short-circuited when seen from ends 14 of the second microstrip line 12. As a result, four open stubs that can be expected to contribute to excitation can be obtained. The four open stubs may not have an attenuation pole or a clear attenuation pole, contribute to forming an attenuation characteristic. In accordance with the present invention, two open stubs are formed on each strip line at the input/output sides. Thus, a large number of stubs can be obtained for the size, and a higher degree of freedom can be allowed for design.

Although four open stubs can be obtained in accordance with the present invention, the number of attenuation poles might be less than four even when the present invention is employed. This is because the frequencies of the attenuation poles of the open stubs might be close to or overlap one another, or might not appear at all under certain conditions. Still, the advantage of having many controllable open stubs is maintained in such cases.

In the above example, microstrip lines are employed as line patterns. However, the present invention can be embodied by employing other transmission lines such as coplanar lines.

The following is a description of embodiments of the present invention, with reference to the accompanying drawings.

First Embodiment

Figure 3:
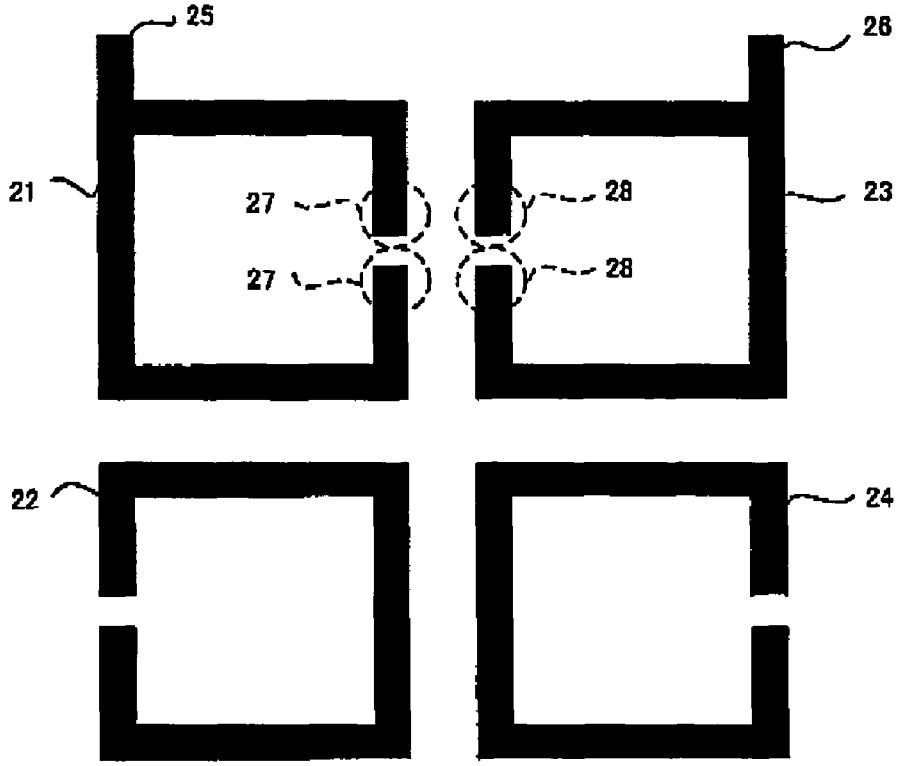
FIG. 3 illustrates a filter in accordance with a first embodiment of the present invention.

FIG. 3 illustrates a filter in accordance with a first embodiment of the present invention. The filter shown in FIG. 3 includes four microstrip lines 21, 22, 23, and 24, and two input/output terminals 25 and 26. These patterns are formed on a dielectric substrate having a ground pattern formed on the back. Each of the microstrip lines 21 through 24 is an open-looped transmission path that is substantially equivalent to ½ of the wavelength λ corresponding to the center frequency of the pass band or a frequency in the neighborhood of the center frequency. So as to form an open loop, each of the microstrip lines 21 through 24 has four bent portions. Having loop-like forms, the microstrip lines 21 through 24 can be arranged in a relatively small area. The microstrip lines 21 and 22 are arranged to provide hybrid coupling by combining capacitive coupling and inductive coupling, the microstrip lines 22 and 24 are arranged to provide inductive coupling, and the microstrip lines 24 and 23 are arranged to provide hybrid coupling by combining capacitive coupling and inductive coupling. Each of the microstrip lines 22 and 24 forms a resonator. Accordingly, the filter shown in FIG. 3 has resonators coupled to each other.

The input/output terminal 25 is provided for the microstrip line 21, and the input/output terminal 26 is provided for the microstrip line 23. The microstrip line 22 is coupled to the microstrip line 21 so that the microstrip line 21 has open stubs in which the connection point between the input/output terminal 25 and the microstrip line 21 appears to be short-circuited when seen from ends 27 of the microstrip line 21. Likewise, the microstrip line 24 is coupled to the microstrip line 23 so that the microstrip line 23 has open stubs in which the connection point between the input/output terminal 26 and the microstrip line 23 appears to be short-circuited when seen from ends 28 of the microstrip line 23. The input/output terminal 25 is located on the side of the microstrip line 21 opposite to the side on which the microstrip line 22 is located. Likewise, the input/output terminal 26 is located on the side of the microstrip line 23 opposite to the side on which the microstrip line 24 is located. Accordingly, the input/output terminals 25 and 26 extend in the same direction as each other.

Figure 4:
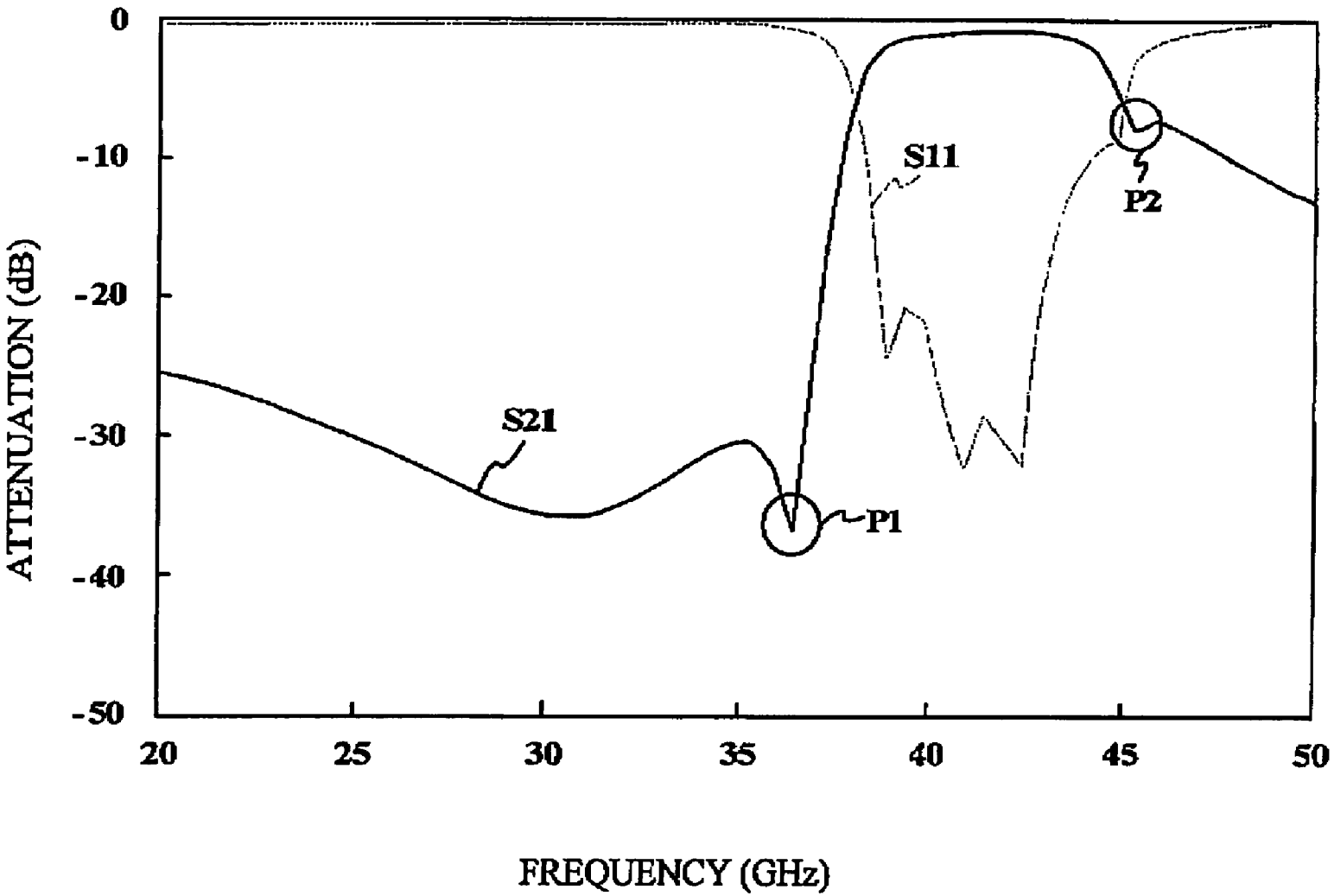
FIG. 4 is a graph showing the frequency characteristics of the first embodiment shown in FIG. 3.

FIG. 4 shows the frequency characteristics of the filter shown in FIG. 3. In FIG. 4, the horizontal axis indicates frequency (GHz), and the vertical axis indicates attenuation (dB). The solid-line curve indicates pass characteristics S21, and the dotted-line curve indicates reflection characteristics S11. An attenuation pole P1 is formed in the vicinity of the low frequency side of the pass band, and the attenuation at the attenuation pole P1 is approximately −37 dB. With the center frequency f of the pass band being 1, the location of the attenuation pole P1 is approximately 0.87 f. Accordingly, the cut-off profile of the low frequency side of the pass band is very sharp. An attenuation pole P2 with a smaller attenuation than the attenuation pole P1 is formed on the high frequency side of the pass band. The filter of this embodiment exhibits asymmetric filter characteristics in terms of attenuation, but can function as a band-pass filter.

Figure 5:
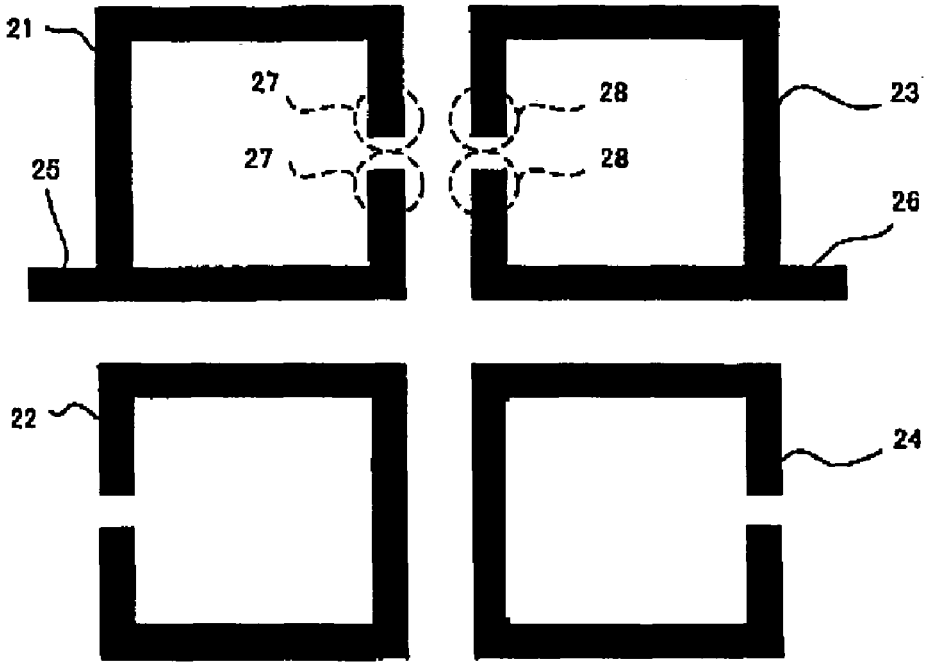
FIG. 5 illustrates a modification of the first embodiment shown in FIG. 3.

FIG. 5 is a modification of the first embodiment. The filter shown in FIG. 5 also includes the four microstrip lines 21 through 24, but has the input/output terminals 25 and 26 located in different positions from the input/output terminals 25 and 26 of the first embodiment. The input/output terminal 25 shown in FIG. 5 is located closer to the microstrip line 22 than to the line that divides the microstrip line 21 into two equal parts. Likewise, the input/output terminal 26 is located closer to the microstrip 24 than to the line that divides the microstrip line 23 into two equal parts. In the structure shown in FIG. 5, the microstrip line 22 is also coupled to the microstrip line 21 so that the microstrip line 21 has open stubs in which the connection point between the input/output terminal 25 and the microstrip line 21 appears to be short-circuited when seen from the ends 27 of the microstrip line 21. Likewise, the microstrip line 24 forms a resonator and is coupled to the microstrip line 23 so that the microstrip line 23 has open stubs in which the connection point between the input/output terminal 26 and the microstrip line 23 appears to be short-circuited when seen from the ends 28 of the microstrip line 23.

Figure 6:
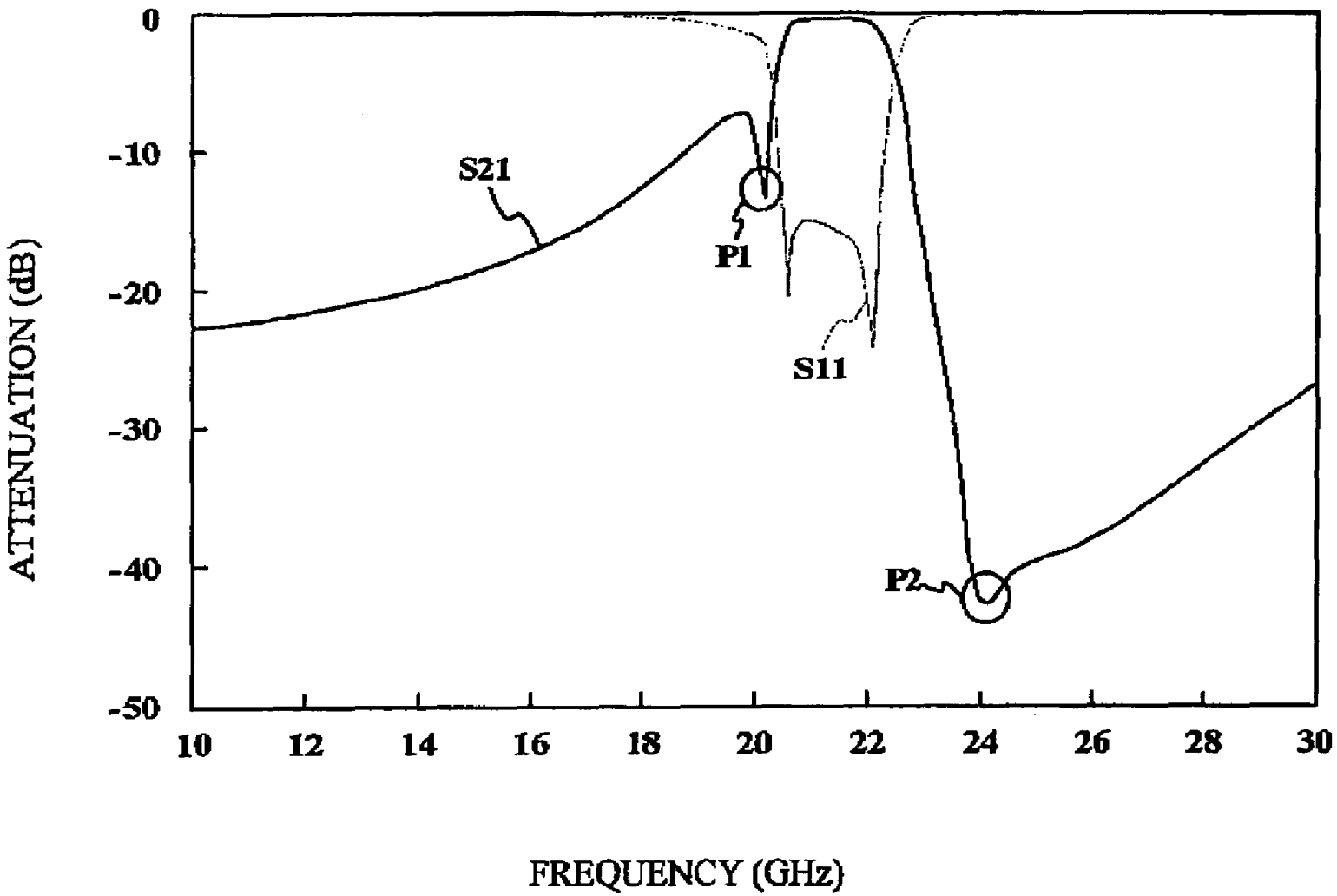
FIG. 6 is a graph showing the frequency characteristics of the modification shown in FIG. 5.

FIG. 6 shows the frequency characteristics of the filter shown in FIG. 5. In FIG. 6, the horizontal axis indicates frequency (GHz), and the vertical axis indicates attenuation (dB). The solid-line curve indicates pass characteristics S21, and the dotted-line curve indicates reflection characteristics S11. An attenuation pole P2 is formed in the vicinity of the high frequency side of the pass band, and the attenuation at the attenuation pole P2 is approximately −44 dB. With the center frequency f of the pass band being 1, for example, the location of the attenuation pole P2 is approximately 1.12 f. Accordingly, the cut-off profile on the high frequency side of the pass band is very sharp. An attenuation pole P1 with a smaller attenuation than the attenuation pole P2 is formed on the low frequency side of the pass band. The filter of this embodiment exhibits asymmetric filter characteristics in terms of attenuation, but can function as a band-pass filter.

The structures shown in FIGS. 4 and 6 differ from each other in the coupling of the microstrip lines 22 and 24 to the microstrip lines 21 and 23, respectively. This implies that the attenuation poles can be adjusted by adjusting the positions of the input/output terminals 25 and 26, and a higher freedom is allowed for design.

Second Embodiment

FIGS. 7A through 7D each illustrate a filter in accordance with a second embodiment of the present invention. The filters shown in FIGS. 7A through 7D use microstrip lines as transmission paths but have different resonator structures from one another. Each of the filters includes microstrip lines 31 and 32 of λ/2 in length, and input/output terminals 34 and 35 that are provided for the microstrip lines 31 and 32, respectively. The microstrip lines 31 and 32 and the input/output terminals 34 and 35 are formed on a dielectric substrate that is indicated by a broken line in each of FIGS. 7A through 7D. A resonator that is described below is interposed between the microstrip lines 31 and 32 in each of the filters. The resonator is coupled to the microstrip line 31 so that the microstrip line 31 has open stubs in which the connection point between the input/output terminal 34 and the microstrip line 31 appears to be short-circuited when seen from the ends of the microstrip line 31. The resonator is also coupled to the microstrip line 32 so that the microstrip line 32 has open stubs in which the connection point between the input/output terminal 35 and the microstrip line 32 appears to be short-circuited when seen from the ends of the microstrip line 32. In the examples shown in FIGS. 7A through 7D, the input/output terminal 34 is located slightly above the line that divides the microstrip line 31 into two equal parts, and the input/output terminal 35 is located slightly below the line that divides the microstrip line 32 into two equal parts. Accordingly, the input/output terminals 31 and 32 slightly deviate from each other and extend in the opposite directions from each other.

Figure 7A:
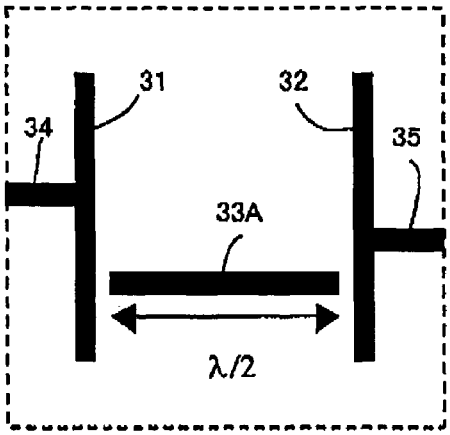
FIGS. 7A through 7D each illustrate a filter in accordance with a second embodiment of the present invention.
Figure 7B:
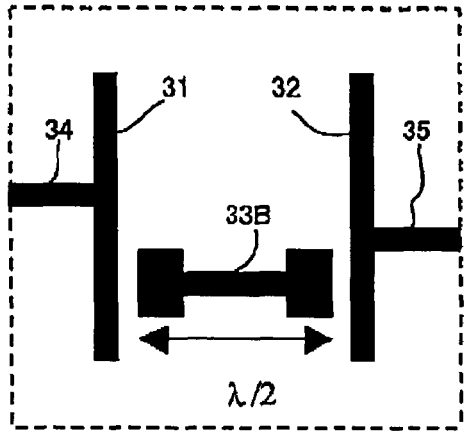
Figure 7C:
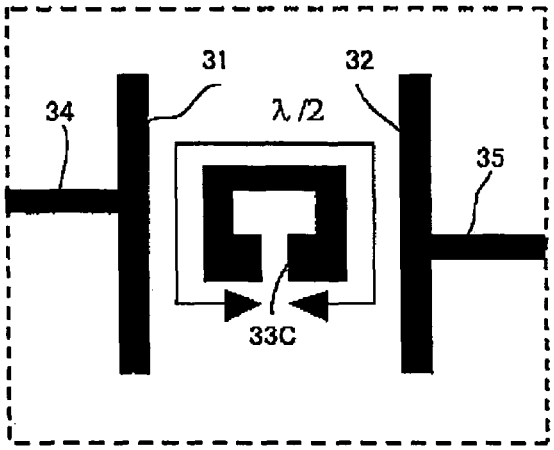
Figure 7D:
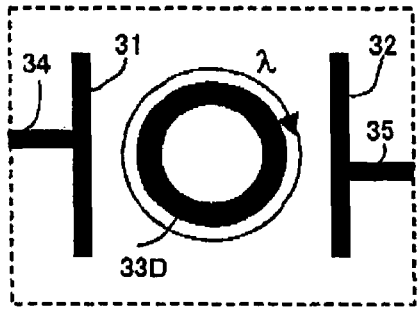

The filter shown in FIG. 7A has a λ/2 open-line resonator 33A. The filter shown in FIG. 7B has a capacity-loaded λ/2 open-line resonator 33B. The filter shown in FIG. 7C has a bent λ/2 open-line resonator 33C. The filter shown in FIG. 7D has a ring-type resonator 33D with a circumference of λ. Each of these filters exhibits the same frequency characteristics as the frequency characteristics shown in FIG. 4 or 6.

Third Embodiment

Figure 8A:
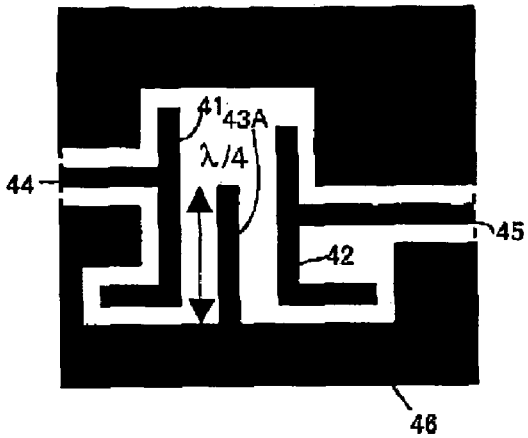
FIGS. 8A through 8C each illustrate a filter in accordance with a third embodiment of the present invention.
Figure 8B:
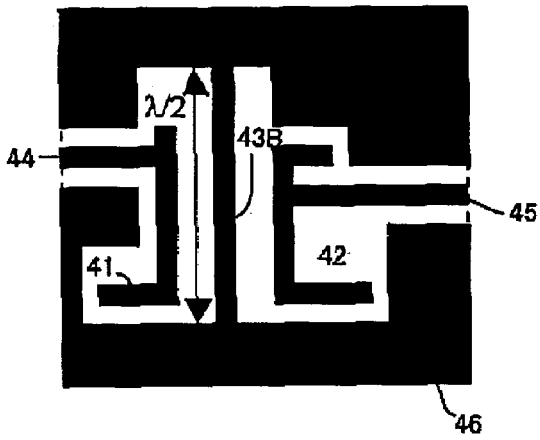
Figure 8C:
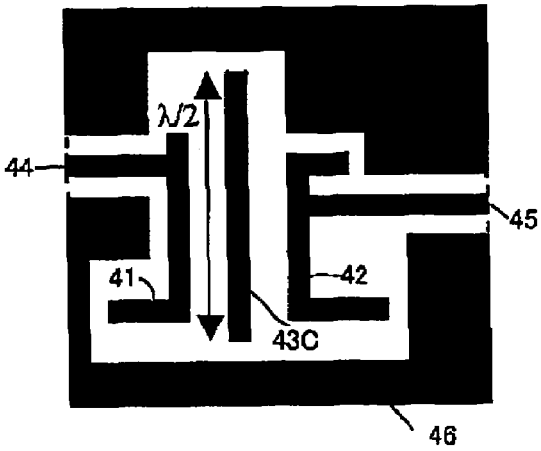

FIGS. 8A through 8C each illustrate a filter in accordance with a third embodiment of the present invention. The filters shown in FIGS. 8A through 8C use coplanar lines as transmission lines but have different resonator structures from one another. Each of the filters includes line patterns 41 and 42 of λ/2 in length, and input/output terminals 44 and 45 that are provided for the line patterns 41 and 42, respectively. The line patterns 41 and 42 and the input/output terminals 44 and 45 are formed on a dielectric substrate that is indicated by a broken line in each of FIGS. 8A through 8C. A ground pattern 46 is also provided so as to surround both ends of each of the line patterns 41 and 42, thereby forming a coplanar line structure. A resonator that is described below is interposed between the line patterns 41 and 42 in each of the filters. The resonator is coupled to the line pattern 41 so that the line pattern 41 has open stubs in which the connection point between the input/output terminal 44 and the line pattern 41 appears to be short-circuited when seen from the ends of the line pattern 41. The resonator is also coupled to the line pattern 42 so that the line pattern 42 has open stubs in which the connection point between the input/output terminal 45 and the line pattern 42 appears to be short-circuited when seen from the ends of the line pattern 42.

The filter shown in FIG. 8A has a λ/4 single-end open-line resonator 43A. The filter shown in FIG. 8B has a λ/2 line resonator 43B having both of the end portions short-circuited. Both of the end portions of the resonator 43B are connected to the ground pattern 46. The filter shown in FIG. 8C has a λ/2 open-line resonator 43C having both of the end portions left open. Each of these filters exhibits the same frequency characteristics as the frequency characteristics shown in FIG. 4 or 6.

Fourth Embodiment

Figure 9:
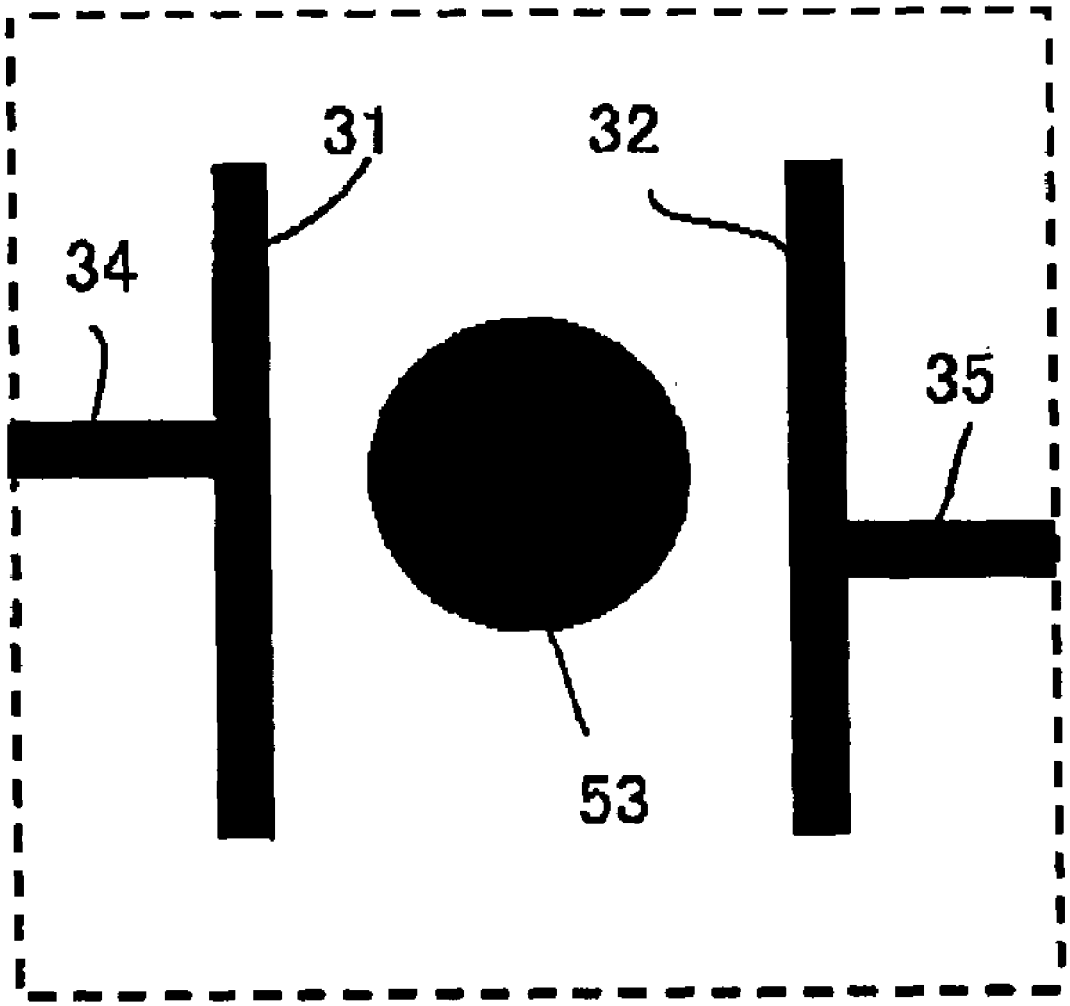
FIG. 9 illustrates a filter in accordance with a fourth embodiment of the present invention.

FIG. 9 illustrates a filter in accordance with a fourth embodiment of the present invention. The filter shown in FIG. 9 is the same as the filter shown in FIG. 7D, except that the ring-type resonator 33D is replaced with a dielectric resonator 53. The other aspects of the structure of the filter shown in FIG. 9 are the same as those of the structure of the filter shown in FIG. 7D. The dielectric resonator 53 is coupled to the microstrip line 31 so that the microstrip line 31 has open stubs in which the connection point between the input/output terminal 34 and the microstrip line 31 appears to be short-circuited when seen from the ends of the line pattern 31. The dielectric resonator 53 is also coupled to the microstrip line 32 so that the microstrip line 32 has open stubs in which the connection point between the input/output terminal 35 and the microstrip line 32 appears to be short-circuited when seen from the ends of the microstrip line 32. The filter shown in FIG. 9 exhibits the same frequency characteristics as the frequency characteristics shown in FIG. 4 or 6.

The present invention also provides filters that have resonators that have different patterns from the resonators described above, or use different line patterns (such as suspended lines or slot lines) from the line patterns described above.

The filters shown in FIG. 3 and the filter shown in FIG. 5 may be connected in series, so as to form a filter that has the combined frequency characteristics of those shown in FIGS. 4 and 6. In such a case, the cut-off profiles on the low frequency side and the high frequency side of the pass band become sharper by virtue of the attenuation poles formed on both ends of each line pattern that function as open stubs.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A filter comprising:

first and second line patterns each having a length substantially equal to ½ of the wavelength of a pass-band frequency; and a resonator that is interposed between the first and second line patterns and is coupled therewith so that the first and second line patterns have open stubs in which connection points between input/output terminals and the first and second line patterns appear to be short-circuited when viewed from ends of the first and second line patterns, the first and second line patterns being coplanar lines, the resonator being a straight line pattern and running in a direction parallel to the first and second line patterns, the resonator being a λ/4 single-end open-line resonator and having an end connected to a ground pattern of the coplanar lines that form the first and second line patterns.

2. The filter as claimed in claim 1, wherein the open stubs form attenuation characteristics or attenuation poles.

3. The filter as claimed in claim 1, wherein the open stubs form two or more attenuation poles.

4. The filter as claimed in claim 1, wherein the resonator includes a plurality of resonators coupled in turn.

5. The filter as claimed in claim 1, wherein the first and second line patterns have a bent pattern or a loop pattern.

6. The filter as claimed in claim 1, wherein the first and second line patterns are located at positions that deviate from centers of the first and second line patterns.

* * * * *